United States Patent [19]

Katshen

[11] 4,250,826

[45] Feb. 17, 1981

[54] ROLLER FURLING STRUCTURE

[76] Inventor: Bernard R. Katshen, 745 - 2nd Ave., Redwood City, Calif. 94063

[21] Appl. No.: 879,217

[22] Filed: Feb. 21, 1978

[51] Int. Cl.[3] ..... B63H 9/10

[52] U.S. Cl. ..... 114/106

[58] Field of Search ..... 114/102, 103, 104, 105, 114/106, 112; 254/163, 164; 308/DIG. 8, DIG. 7

[56] References Cited

U.S. PATENT DOCUMENTS

| | | | |
|---|---|---|---|
| 1,003,333 | 10/1911 | Campbell | 254/164 |
| 2,691,814 | 10/1954 | Tait | 308/DIG. 7 |
| 2,796,038 | 6/1957 | Pegel | 114/103 |
| 2,858,789 | 11/1959 | Stearns | 114/103 |
| 3,980,036 | 10/1976 | Crall | 114/106 |

*Primary Examiner*—Charles E. Frankfort
*Assistant Examiner*—Jesus D. Sotelo
*Attorney, Agent, or Firm*—Julian Caplan

[57] ABSTRACT

An improvement upon U.S. Pat. Nos. 3,789,790; 3,749,043; and 3,980,036 employs a winch mounted on the furling drum to tighten each halyard. The winch has teeth resembling pinion gear teeth which engage the openings in a stainless steel roller chain, the upper end of which is attached to the ear of a traveler swedged to the lower end of the halyard. A latch on the winch locks the chain in position after it has been tightened and further functions to assist in inserting the end of the chain into the winch. The furling structure may be installed on a stay (as for a jib) or a special stay may be installed on a mast or spar; with the special stay supported by top and bottom brackets attached to the mast and spacing the stay away from the mast. The sail has a luff formed by the use of hard braided luff line enclosed in Teflon-coated tape which is sewn to the sail. The luff line is inserted in slots in the roller spool sections. At the tack and head webbing is sewn to the sail, projecting beyond the ends thereof and carrying rings. The head ring is attached by a shackle to the end of the halyard. The tack ring is attached by a pin to ears on the upper surface of the furling drum.

6 Claims, 7 Drawing Figures

ROLLER FURLING STRUCTURE

This invention relates to a new and improved roller furling structure and is an improvement over prior U.S. Pat. Nos. 3,980,036, 3,789,790 and 3,749,043.

The present invention differs from the foregoing patents in several respects. One feature of the present invention is the fact that roller furling is applied to the exterior of a mast or boom so that the main sail or mizzen sail may be roller furled. Brackets are attached at the top and bottom of the mast and a furling spool similar to that of the foregoing patents rotates around a stay which extends between the two brackets, the stay being spaced from the mast a sufficient distance to permit furling.

Another feature of the invention is the provision of means to tighten the halyard. The means herein illustrated and hereinafter described provides a winch mounted on the furling drum which tightens a chain, the upper end of which is attached to the ear of a traveler fixed to the lower end of the halyard and sliding in one of the grooves of the furling spool. The winch has a pinion-like member, the teeth of which fit in the spaces between the rollers of the chain. By turning the pinion using a crank having a large throw, the pull on the halyard is improved. A further feature of the invention is the presence of a latch on the winch which locks into the teeth of the pinion and prevents rotation after the halyard has been sufficiently tightened. The latch not only functions in the manner heretofore mentioned but also, when turned to a different position, facilitates insertion of the end of the chain into engagement with the pinion.

A still further feature of the invention is the structure of the traveler which is attached to the lower end of the halyard. The traveler is a circular cross section rounded end member formed as a sleeve on its upper end. The end of the halyard is inserted in the sleeve and the halyard is then roller swedged so that the sleeve is the same diameter as the lower end of the traveler, thereby tightly engaging the halyard. A further feature of the traveler is the provision of an aperture in the ear of the traveler which extends outside the spool which enables a line to be attached to the ear to pull the halyard during initial installation of the sail.

A still further feature of the invention is the structure of the luff of the sail which fits into the spool bore through slots. The luff consists of a luff rope or line which is, preferably, quite stiff (to facilitate initial installation) and is connected to the edge of the sail by the use of a Teflon-impregnated tape which is bent into U-shape, the edges of the tape being sewn to the sail and another line of stitching parallels the luff line on the inner edge. The luff slides freely in the luff slot of the furling spool and does not snag at the joints of the spool or bind on contact with the edges of the slots in the spool.

A still further feature of the invention is the use of ribbons at the head and tack of the sail which are sewn to the sail luff and extend a few inches upward or downward from the ends of the sail. The ribbon is bent in U-shape and a ring is installed which may be connected by a shackle to the halyard at the head end of the sail. At the tack end of the sail, the ring in the ribbon is received in a pin which extends between two lugs upstanding from the surface of the furling drum.

Other objects of the present invention will become apparent upon reading the following specification and referring to the accompanying drawings in which similar characters of reference represent corresponding parts in each of the several views.

Figures 1, 2, 3, 4, 5, 6, 7:
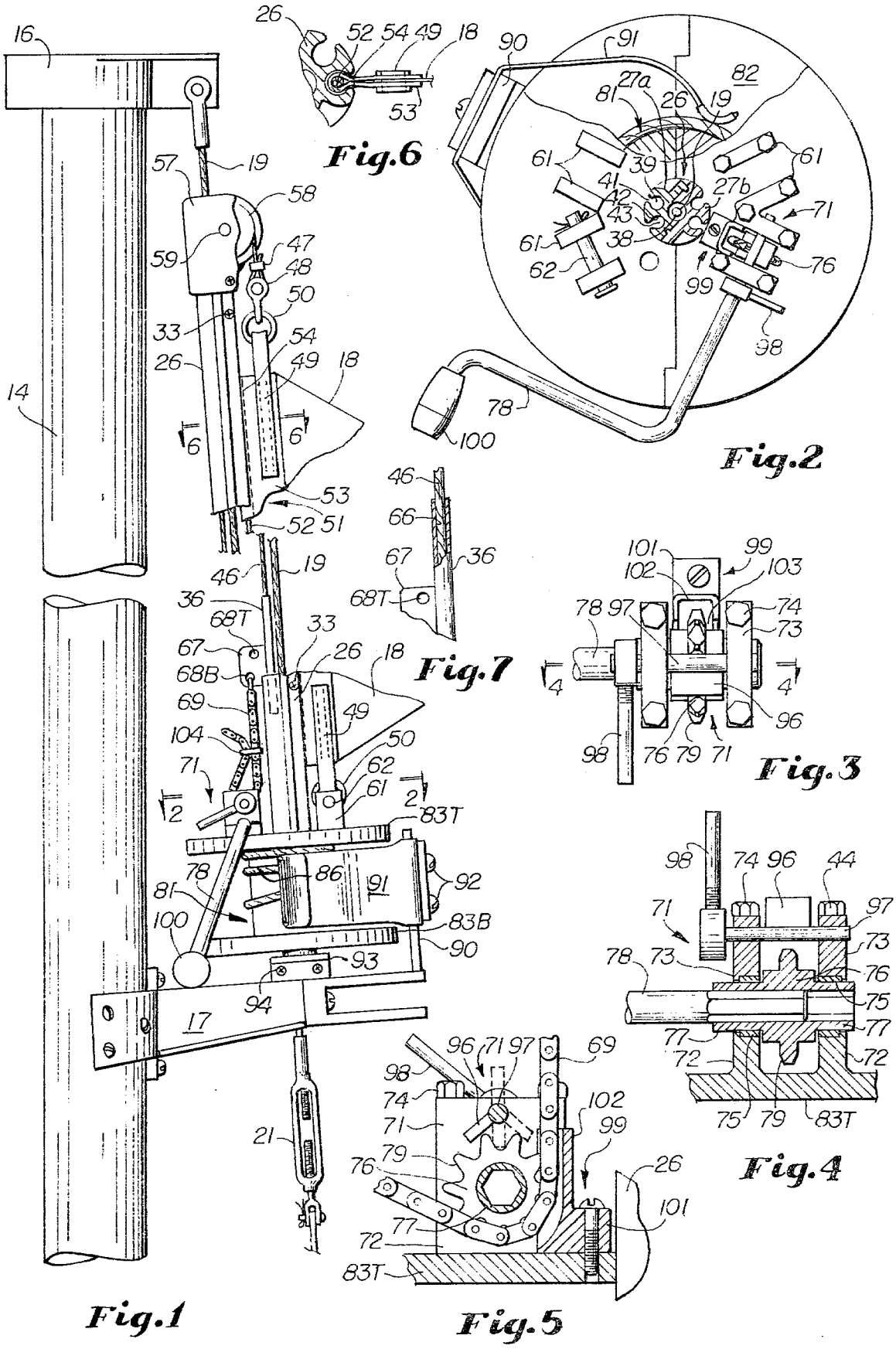
FIG. 1 is an elevational view broken away to conserve space showing the invention installed on a shroud which extends parallel to a mast.
FIG. 2 is a sectional view taken substantially along the line 2—2 of FIG. 1.
FIG. 3 is a top plan view of the winch.
FIG. 4 is an enlarged sectional view taken substantially along the line 4—4 of FIG. 3.
FIG. 5 is an elevational view of the structure of FIG. 4.
FIG. 6 is an enlarged fragmentary sectional view taken substantially along the line 6—6 of FIG. 1.
FIG. 7 is an enlarged fragmentary elevational view, partly broken away in section, of a traveleer attached to a halyard.

As has been noted, the present invention is an improvement upon several prior patents of Donald H. Crall. So far as convenient, the same reference numerals are used herein as are used in U.S. Pat. No. 3,980,036; and where the elements have similar function, in many instances such function is omitted in the present specification.

The present invention is installed on a mast 14 or on a boom. It will be understood, however, that the structure can be incorporated on the stay of a jib as in the preceding patents. In some prior art structures, the mast rotated or the sail was rolled on a roller within the hollow mast. Such is not, however, the case in the present invention. A head bracket 16 is attached to the mast 14, preferably at the top thereof, and a lower bracket 17 is affixed to the mast 14 at about the deck level. Stay 19 is fixed to the brackets 16 and 17 and carries a sail 18 which is here shown as a main sail but could be a jib. Turnbuckle 21 is used to tighten the stay 19 as well understood in this art.

Rotatable about stay 19 is a spool 26 made up of a plurality of overlapping sections each having a spool half **27*a* or 27*b* joined together by means of screws 33. Center opening 38 in the spool 26 encloses stay 19, the spool 26 rotating about stay 19 during furling and unfurling. Each spool half 27*a* or 27*b* has a first bore 39 which extends longitudinally thereof parallel to the opening 38 but spaced radially outward, and first slot 41 extends from the bore 39 out to the periphery of the spool. Similarly, there is a second bore 42 and a second slot 43 in each half 27*a* or 27*b*. The use of two bores 39, 42 is desirable for the use of two sails on a single furling spool but only two bores may be formed in the spool or two bores may be left empty. One of the bores receives the luff of sail 18 and the opposite bore receives halyard 46 which is used to hoist the sail. Halyard 46 is formed with an eye 47 which is connected by shackle 48 to a ribbon 49 sewn to the luff at the head of sail 18 and carrying ring 50 through which the shackle 48 passes. At the tack (lower) end of the sail 18 similar ribbon 49 and ring 50** are used.

An improved luff construction is shown in FIG. 6. Luff 51 is constructed around a luff rope or line 52 which fits through one of the bores 39, 42 of spool 26. Tape 53 is sewn to the luff edge of sail 18, around the line 52 and on to the opposite surface of the sail. A line of stitching 54 parallel to and adjacent luff line 52 encloses the luff line and holds the tape 53 in place. Tape 53 is preferably impregnated with Teflon or other slick surfacing material and several lines of Teflon impregnated stitching may parallel stitching 54. This insures that the luff 51 will slide freely in the slot 41 and bore 39 as the sail is raised and lowered.

The halyard 46 extends from the eye 47 up around the crown block 57 which is positioned at the top of the spool 26 and rotates therewith. Within crown block 57 is a pulley 58 rotatable about a pin 59. On the opposite end of halyard 46 is traveler 36 which has a bore 66 at its upper end which receives the end of the halyard 46. Initially, this bore 66 is enlarged. After the halyard 46 is inserted therein, the diameter of the traveler at its upper end is reduced, preferably by roller swedging, tightly attaching the traveler 36 to the halyard. Halyard 46 passes through the bore 41 as does traveler 36. An ear 67 extends radially outwardly from traveler 36 through slot 43 to the exterior of spool 26 and ear 67 is formed with top and bottom apertures 68T, 68B. Roller chain 69, preferably formed of stainless steel, is attached by means not shown herein through aperture 68B to the ear 67. By pulling chain 69, the halyard 46 may be tightened as hereinafter described.

Mounted on the lower end of the spool 26 is furling drum 81, the details which are described in said U.S. Pat. No. 3,980,036. The drum 41 consists of two halves 82 and has top and bottom flanges 83T, 83B. Furling line 86 is wrapped around the drum 81 and extends out to the cockpit. Fixed by screws 92 and projecting from bracket 90 on either side are arcuate line guards 91 which substantially enclose drum 81, preventing line 86 from falling off the drum and also preventing injury to personnel. By pulling line 86, the drum 81 and the spool 26 are caused to rotate, wrapping sail 18 around the spool 26 to furl the same. By means not herein shown, the tack at the opposite end of the sail 18 may be pulled, causing unfurling provided the line 86 is permitted to run. Drum 81 is supported by a bearing pad 93 and a thrust bearing 94 which fit around the stay 19 above leg 88 and bracket 90 and are supported by turnbuckle 21.

The ribbon 49 on the tack end of sail 18 is connected to lugs 61 on the top surface of flange 83T, pin 62 passing through the lugs 61 and also through the ring 50 on ribbon 49B.

For each halyard 46 which is in use (there being two such halyards in use when twin jibs are being sailed) there is a winch 71 on the top surface of flange 83T. Winch 71 is supported by two parallel lugs 72 which extend up from flange 83T having caps 73 molded to lugs 72 by bolts 74. Rotatably supported by lugs 72 and caps 73 is a pinion 76 having ends 77 received in bushings 75 extending from the interior partially toward the exterior of lugs 71. The pinion 76 is preferably hollow having a non-circular bore which receives the non-circular end of a crank handle 78. Thus by turning the handle 78 the pinion 76 may be caused to wind and unwind. Pinion 76 has teeth 79 similar to those of a gear and these teeth 73 fit into the spaces between the rollers of chain 69. Thus by turning handle 78 the chain 69 may be pulled downward, tightening the halyard 46.

To latch the winch 71, a rectangular latch 96 extends out from latch pin 97 which fits into a hole in caps 73. A handle 98 having ball end 100 turns latch 96. In the dotted line position of latch 96 shown in FIG. 5, turning of the pinion 76 is prevented after the chain 69 has been tightened.

Behind winch 76 is a chain guide consisting of a base 101 fixed to flange 83T and having an upward extending channel 102 which is behind chain 69 relative to pinion 76 (see especially FIGS. 3 and 5). Radius 103 at the juncture of channel 102 with base 101 directs chain 69 into engagement with pinion 76 (see especially FIG. 5). When the latch 96 is in its dotted line position, as viewed in FIG. 5, the latch 96 functions, along with the channel 102, to guide the lower end of the chain 69 into proper contact with the pinion 76 as the handle 78 is turned. After tightening of the chain 69, a tie 104 (see FIG. 1) may be used to prevent the chain from interfering with furling and unfurling of the sail.

Installation of the structure is similar to that described in U.S. Pat. No. 3,980,036. The topmost spool section and crown block 57 are installed around stay 19. The halyard 46 is inserted around pulley 58 and down through one of the bores in the topmost spool section. A line (not shown) is attached through hole 68T.

Additional spool sections are installed and the drum 81 installed, is in the aforementioned Patent. Top ring 50 is attached to shackle 48 and the luff 51 of the head of the sail 18 is inserted through a window (not shown) in the bottommost spool section. The line attached to the ear 67 through hole 68T is pulled to raise the sail.

Ring 50 on the tack end of sail 18 is fastened to lugs 61 by pin 62. To tighten halyard 46, the lower end of chain 69 is inserted between winch 71 and back 99, handle 98 being turned to the dotted line position of FIG. 5 to assist in the assertion. Handle 78 is turned until the halyard is tight. Latch 96 is inserted between two teeth 79; handle 78 is removed; tie 104 is attached.

Furling and unfurling are performed as in the prior Patent.

What is claimed is:

1. In a furling assembly adapted for installation on a stay having a hollow spool rotatable about said stay formed with a first and a second longitudinal bore and first and second slots each extending out to the exterior of said spool from said first and second bore, respectively, a crown block on the top of said spool having a sheave, a furling drum fixed to the bottom of said spool, said drum having a top flange, a sail having a luff, means securing said luff within said first bore, a halyard partially in said first bore extending around said sheave and down said second bore, a traveller in said second bore fixed to the lower end of said halyard, said halyard having an ear extending out through said second slot, said ear formed with an aperture, the improvement which comprises a roller chain, means securing the upper end of said chain to said ear through said aperture, a winch, mounting means mounting said winch on said top flange, said winch having a rotatable member having a pinion having teeth shaped to engage said chain by fitting into spaces between rollers in said chain and tighten said chain as said rotatable member is turned, means to turn said rotatable member and latch means to latch said rotatable member and thereby fix said chain in position, said latch means comprising a pin oscillatable in said mounting means having a handle to turn said pin and a latch, said latch shaped to fit between two of said teeth to restrain rotation of said winch when said latch means is in a first position and to be disengaged from said pinion when said latch means is in a second position.

2. The improvement of claim 1 which further comprises a back fixed to said top flange having a channel extending up from said top flange, said chain sliding within said channel, said channel retaining said chain in engagement with said pinion.

3. The improvement of claim 2 in which said latch has a third position near said first position, said latch and said channel guiding insertion of the lower end of said chain into said winch.

4. The improvement of claim 1 which further comprises a ribbon sewn to the luff of said sail and extending down below the tack of said sail, a ring on said ribbon, a pair of lugs extending up from said top flange, and a pin extending through apertures in said lugs and through said ring to secure the tack of said sail to said drum.

5. The improvement of claim 1 in which said luff comprises a luff line, a tape folded in U-shape and stitched longitudinally parallel and adjacent to the base of said U, said line being in said base, and means fixing said tape to the luff edge of said sail, said tape being of a smooth, slippery finish to slide freely within said first slot.

6. The improvement of claim 1 which further comprises a mast, a head and a lower stay bracket fixed to said mast, said stay having means to fix said stay in position relative to said head and lower stay brackets spaced away from said mast so that said spool and said drum may turn freely relative to said mast.

* * * * *